United States Patent [19]

Neward

[11] Patent Number: 4,700,861

[45] Date of Patent: Oct. 20, 1987

[54] CONTAINER CAP FOR LIQUID TRANSFER

[76] Inventor: Theodore C. Neward, 521 Scripps Dr., Claremont, Calif. 91711

[21] Appl. No.: 905,793

[22] Filed: Sep. 10, 1986

[51] Int. Cl.[4] ..... B65D 47/14

[52] U.S. Cl. ..... 215/309; 215/311; 141/46; 141/67; 222/211; 222/481

[58] Field of Search ..... 215/309, 311, 307; 222/211, 464, 481; 141/67, 46

[56] References Cited

U.S. PATENT DOCUMENTS

| | | | |
|---|---|---|---|
| 1,577,539 | 3/1926 | Polk | 215/309 |
| 2,783,919 | 3/1957 | Ansell | 222/211 |
| 2,836,179 | 5/1958 | Ryan | 215/309 X |
| 3,084,823 | 4/1963 | Reichstein | 215/311 |
| 3,868,039 | 2/1975 | Holbrook | 215/309 |
| 3,878,962 | 4/1975 | Holbrook et al. | 215/309 |

*Primary Examiner*—Donald F. Norton
*Attorney, Agent, or Firm*—Lyon & Lyon

[57] ABSTRACT

A container lid for liquid transfer having a double-tapered liquid transfer sleeve for providing an air-tight seal around a fluid transfer conduit and having an air passage part.

15 Claims, 12 Drawing Figures

CONTAINER CAP FOR LIQUID TRANSFER

FIELD OF THE INVENTION

This invention relates to the field of caps and lids for containers utilized in the transfer of fluid between different containers.

BACKGROUND OF THE INVENTION

The desirability of transferring liquid from one container to another without the necessity of, or ability to, pour the liquid from the first container in to the second container has long been known. Prior apparatus for accomplishing this transfer of fluid have utilized a differential in the air pressure between the respective containers to accomplish this transfer. Either the pressure was reduced in the receiving container, i.e., a partial vacuum was created, or the pressure in the dispensing container was increased above that in the receiving container. In either instance, fluid flowed from the higher pressure container into the lower pressure container.

One type of device already known in the art connects the fluid receiving container to the fluid dispensing container by means of a hose or conduit. The receiving container is tightly sealed and a vacuum pump connected to the receiving container reduces the air pressure within the container. Due to the reduction of pressure within the receiving container, the fluid in the dispensing container, which is subjected to atmospheric pressure is caused to flow through the hose or conduit into the receiving container, thereby effecting fluid transfer. Devices of this type are commercially available. One such device is sold by Neward Enterprises, under the trademark "Mityvac". These prior devices have suffered from an inability to satisfactorily transfer viscous fluids, such as motor oil or heavy transmission fluid, caused by an improper seal around the hose or conduit in the fluid receiving chamber and the minimal projected cross-sectional area of fluid tube exposed to either vacuum or pressure.

An alternate type of device presently utilized for the transfer of fluids is a squeeze bottle. In this type of device, pressure is exerted on a flexible bottle or container reducing the volume of the container, which thereby increases the air pressure within the container which, in turn, forces fluid within the container out through a hose or nozzle which is exposed to the now-lower atmospheric pressure. This type of prior device has also suffered from an inability to maintain a proper seal about the hose or nozzle when using a larger projected cross-sectional area of fluid tube exposed to either vacuum or pressure, which results in a reduced liquid transfer rate.

A need, therefore, exists for a cap or lid for liquid transfer containers which will provide a sufficient seal to maintain a vacuum or pressure differential sufficient to transfer viscous fluids under a vacuum or other fluids under pressure.

SUMMARY OF THE INVENTION

The present invention is comprised of a container lid having a cylindrical sealing sleeve formed as an integral part of the lid. The interior of the sleeve is double-tapered, having a slight taper along the major portion of its length with a sharper taper being provided at the end of the sleeve. The container lid may be a separate and distinct piece, such as the top on an ordinary mason jar, which is fastened to the container by an external fastening device in conjunction with a seal means, such as a gasket, to provide an air-tight seal. The lid may also be integrally formed with the fastening device, such as in a top for an ordinary squeeze bottle. In either embodiment, once attached to the container, an air-tight seal is provided around the edge of the lid. Liquid transfer, either into or out of the container, is accomplished by means of a flexible conduit or tube, which is inserted into the container through the cylindrical sealing sleeve. The slight taper of the sleeve creates an increasing squeezing or sealing force between the walls of the sleeve and the exterior of the tube. The second or sharper taper provides a stronger and improved seal at the external point of contact between the tube and the sleeve, particularly in larger diameter tubing. The remaining end of the tube is submerged in the liquid to be transferred into or from the container.

In the rigid, such as a mason, jar configuration, a vacuum port is also integrally formed in the lid. A tube or conduit connects the vacuum port to an external vacuum pump which, in turn, is used to form a partial vacuum within the container. As the vacuum is created, the flexible tubing, the interior of which is at atmospheric pressure, will expand outward slightly, thereby increasing the sealing force between the tube and the sealing sleeve. In particular, at the end of the sleeve, the increased taper will result in an even greater sealing force being created.

When the proper pressure differential between the receiving container and the dispensing container is received, fluid transfer will occur, providing that a sufficient vacuum or pressure is exerted on the surface of the fluid to overcome the viscosity of the fluid.

In the alternate flexible or squeeze bottle configuration of the container, the vacuum port is removed or replaced by an intake port equipped with a one-way valve. In this embodiment, fluid is transferred from the container rather than into it. Pressure is exerted o the exterior of the container which reduces the interior volume of the container's interior. This, in turn, causes the air pressure within the container to increase. The increased air pressure causes the sealing sleeve to be squeezed or compressed about the tube, thereby increasing the sealing force. Air is prevented from escaping the container by means of the one-way valve located over the intake port. The increased pressure forces fluid out of the container through the tube, which now acts as a discharge tube. When the pressure on the container is released, air enters the container through the intake port and the discharge tube.

In a variation of the flexible bottle configuration, the one-way valve may be eliminated. In this variation, air enters the container through the tube upon releasing the pressure on the container.

The invention may also be used as an automatic siphon when attached to the discharge container. When utilized as an automatic siphon, the vacuum port is left exposed to the atmosphere. During the siphoning or transfer of fluid out of the container, air flows into the container through the vacuum port replacing the transferred fluid. Once fluid transfer has started, by merely covering the vacuum port the fluid transfer will cease allowing the discharge tube to be moved into a new receiving container, whereupon by uncovering the vacuum port the siphon action will resume.

Thus, it is an object of this invention to provide an improved lid for liquid transfer containers.

Figure 1:
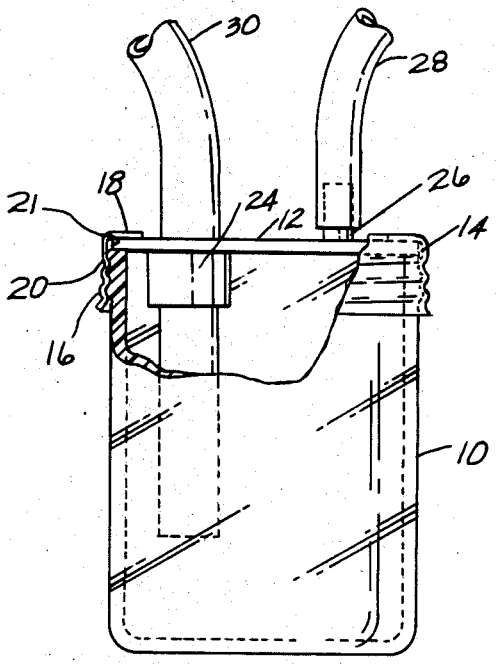
FIG. 1 is a partial cross-sectional side view of the preferred embodiment of the invention.
Figure 2:
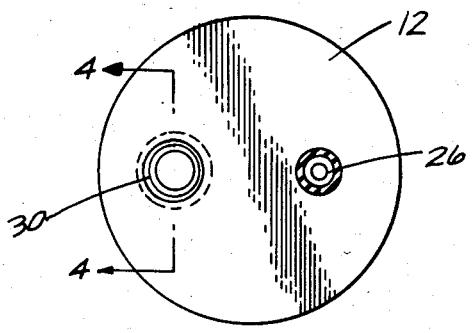
FIG. 2 is a top view of the preferred embodiment of the invention.

DETAILED DESCRIPTION A preferred embodiment of the subject invention is shown in FIGS. 1–4. A liquid container 10 is shown in FIG. 1. A lid 12 is held in place on the container 10 by means of retaining ring 14. In the preferred embodiment, the side wall 16 of the retaining ring 14 is threaded in such a manner as to mate with a similar thread pattern on the exterior wall of the container. An annular flange 18 extends inwardly at the top retaining ring 14, such that when the retaining ring 14 is threaded onto the container 10, the lid 12 is held firmly in place by the annular flange 18.

As shown in FIG. 1, the lid 12 rests upon shoulder 20 located at the bottom of the mouth 22 of container 10. By tightening the retaining ring 14, an air-tight seal may be created between the lid 12 and the container 10. In alternate embodiments, a gasket or other sealing enhancement means may be used to improve the seal between the lid and the container 10.

A cylindrical sealing sleeve 24 is integrally formed in lid 12 and extends inward within the container 10 when the lid 12 is in place. A vacuum port 26 is also integrally formed in the lid 12 and extends outward from the lid. A vacuum line 28 is connected to the vacuum port 26. The remaining end of the vacuum line is connected to a vacuum pump (not shown). The vacuum pump may be one of many readily available types.

A liquid transfer line 30 is inserted through the sealing sleeve 24 into the container 10. In the preferred embodiment, the liquid transfer line is a flexible cylindrical tube. The sealing sleeve 24 is shown in detail in FIG. 4. The inner wall 32 of the sleeve 24 is tapered inwardly from the lid 12 towards the bottom of the sleeve, to a point 34 located above the bottom of the sleeve, thereby reducing the diameter of the sleeve. At point 34, the inward taper of the inner wall of the sleeve increases, thereby forming sealing edge 36 at the intersection of the tapered inner wall of the sleeve and the bottom edge 38 of the sleeve, which aids in maintaining the seal when pressure differentials occur.

To prevent the liquid transfer line 30 from being crimped or pinched when bent during use, the sealing sleeve is of sufficient length to maintain the tubing shape and the mouth 40 is beveled outward providing a slanted shoulder 42 for the tube to rest against, if deflected, when subjected to a lateral force sufficient to bend or deflect the transfer line 30.

The inventor has found that for transferring viscous fluids, such as motor oil or heavy transmission fluid, a fluid transfer line having a $\frac{3}{8}$ inch inner diameter and a $\frac{1}{2}$ inch outer diameter provides the optimal results. Further, when utilizing a vacuum pump capable of drawing a vacuum of 28–29 inches of mercury, an upper taper 33 of approximately 1 degree and a lower taper 35 of approximately 10 degrees provides an optimal seal between the sleeve and the fluid transfer line. In the preferred embodiment, the sleeve 24 is approximately $\frac{5}{8}$ inches in total length and point 34 is located 1/16 inch from bottom edge 38.

In operation, the free end of the transfer line 30 is inserted in the container of fluid which is to be transferred. A vacuum is created in container 10 by means of the vacuum pump. As the vacuum is created in the container, the wall 31 of that portion of transfer line 30, within the container 10, which is under a higher pressure, expands slightly outward, thereby increasing the pressure between the sealing edge 36 and the exterior surface 37 of the transfer line to increase, which thereby increases the seal between them. This enables a more consistent vacuum to be obtained in the fluid receiving container which, in turn, allows for the transfer of viscous fluids, which transfer could not be easily or effectively obtained with prior devices. This feature also allows the usag of tubes having a larger inner diameter while still maintaining a tight seal thereby making it easier to transfer viscous fluids.

Figure 3:
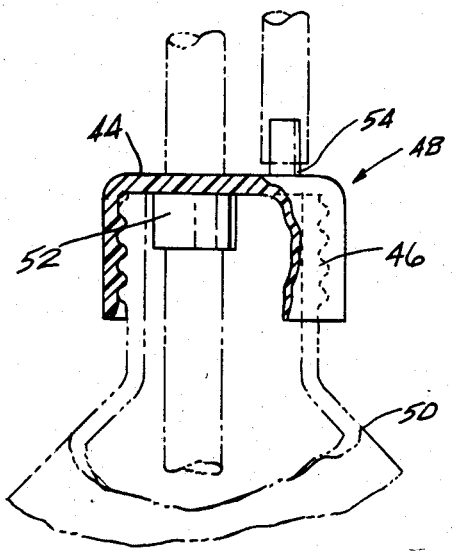
FIG. 3 is a partial cross-sectional side view of an alternate design of the preferred embodiment of the invention.
Figure 4:
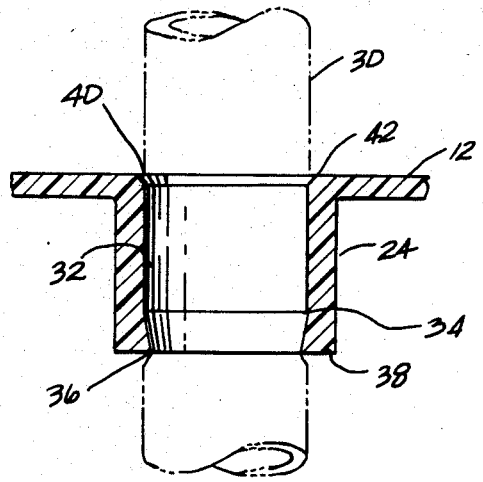
FIG. 4 is a cross-sectional side view of the sealing sleeve.
Figure 5:
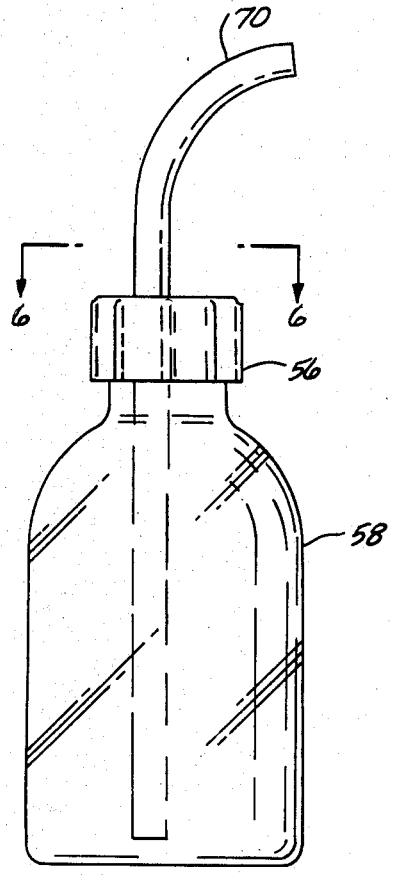
FIG. 5 is a side view of an alternate embodiment of the invention.

An alternate configuration of this embodiment is shown in FIG. 3. As shown in FIG. 3, the lid 44 is integrally formed with the retaining ring 46 in the form of a single cap 48, which is threaded onto the container 50. A with the first configuration, a sealing sleeve 52 and a vacuum port 54 are integrally formed as part of the cap 48.

It is to be noted that while a preferred embodiment described above utilizes a vacuum pump to withdraw air from the fluid receiving container, the subject invention can also be used in connection with a fluid dispensing container. In such a use, the lid is connected to the fluid dispensing container, and a compressor or other air input source is connected to port 26. Fluid transfer is then accomplished by increasing the air pressure within the fluid dispensing container, thereby forcing the fluid out of the container through liquid transfer line 30. In this operation the increased pressure within the container 10 causes the sleeve 23 to be compressed about the transfer line 30 thereby increasing the sealing force between the sleeve 24 and transfer line 30 in the same manner previously described.

Another embodiment of the invention is show in FIGS. 5–8. In this embodiment, liquid transfer is prompted by an increased pressure in the liquid dispensing container, as opposed to a reduced pressure or vacuum being created in the receiving container.

Figure 6:
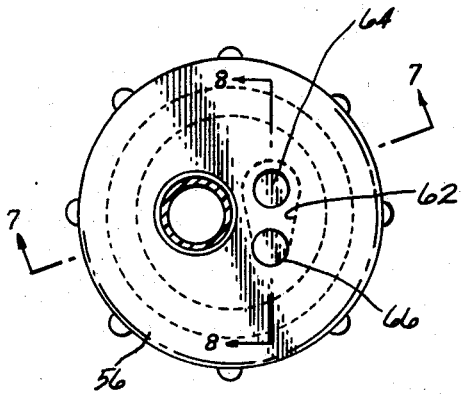
FIG. 6 is a top view of the alternate embodiment shown in FIG. 5.
Figure 7:
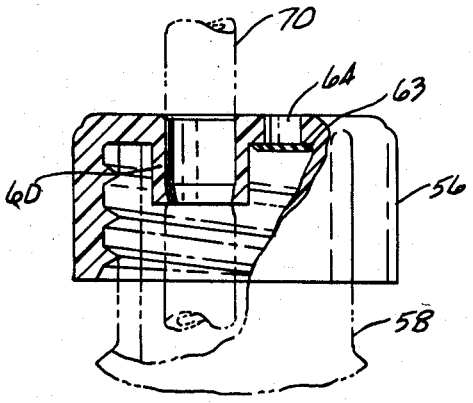
FIG. 7 is a partial cross-sectional side view of FIG. 5.
Figure 8:
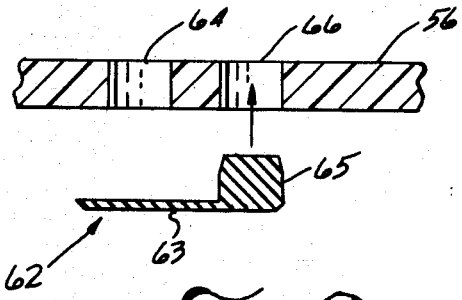
FIG. 8 is a cross-sectional side view of the flapper valve.

A threaded cap 56 is connected to a flexible container 58. A sealing sleeve 60 is integrally formed in the cap 56. The sealing sleeve 60 is the same as the sealing sleeve 24 previously described and shown in FIGS. 1 and 4. A tube or conduit 70 is inserted into the container 58 through sealing sleeve 60. A one-way valve 62, which may be a flapper, duckbill, umbrella or any other suitable valve, is attached to the cap, as shown in FIGS. 6 and 8. A pair of apertures 64 and 66 are situated adjacent to one another in the top of the cap 56. The flapper valve consists of a flat pliable or flexible member 63 having a tab 65 extending perpendicularly outward from the member 65. The tab 65 has the same configuration as the aperture 66 which, in the preferred embodiment, is cylindrical. The exterior diameter of the tab 65 is slightly larger than that of aperture 66. The flapper valve is connected to the cap 48 by press-fitting the tab 65 into the aperture 66 on the inside of the cap, such that flat member 63 covers aperture 64, as shown in FIG. 6.

This embodiment is useful for the transfer of a variety of fluids in addition to the transfer o viscous fluids.

To transfer fluid from the container, the user squeezes the flexible container, which reduces the volume of the container, thereby increasing the pressure within the container. The increased pressure causes the sealing sleeve to contract about the tube 20, providing an airtight seal. At the same time, the flexible member 63 of the flapper valve is pressed upward against the bottom surface of the lid, thereby providing an airtight seal around the inlet aperture 64 The increased pressure within the container forces fluid out through the tube 70. Upon release of the pressure on the container 58, the air pressure within the container will be less than that of the surrounding environment due to the dispensation of liquid from the container. Therefore, outside air will enter the container through intake aperture 64 and the tube 70.

In some instances it is desirable to have air re-enter the squeeze bottle 58 through tube 70 rather than through the valve in the lid 56. In this instance valve 62 and apertures 64 and 66 are eliminated, the only aperture in lid 56 being the passageway through the cylindrical sealing sleeve 52.

In both the rigid and flexible container embodiments of the invention described above, the inventor has found instances in which it is desirable to utilize a different size transfer line. The modification of the invention to accommodate transfer tubes of differing size is shown in FIGS. 9–12.

Figure 9:
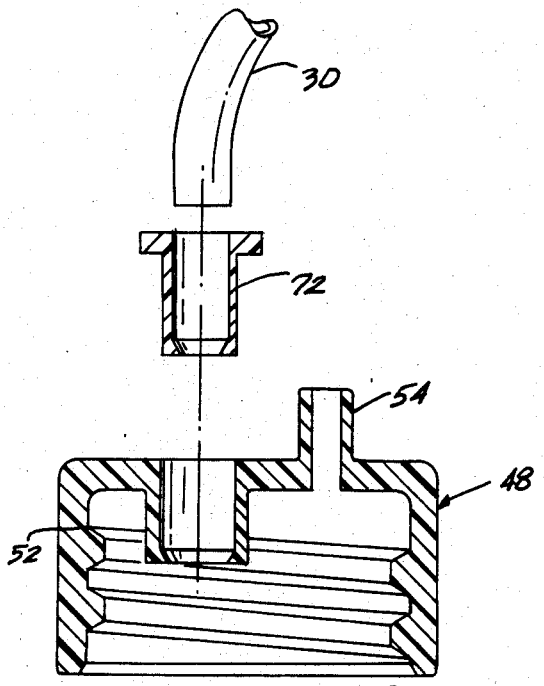
FIG. 9 is a cross-sectional side view of an alternate embodiment of the cylindrical sealing sleeve configuration.

The flexible bottle cap arrangement of FIG. 3 is shown in FIG. 9. Cap 48 includes integrally formed sealing sleeve 52 and vacuum port 52. Sealing sleeve 52 is of double-taper design a previously discussed with respect to sleeve 52 and sleeve 24. To accomodate a smaller sized transfer tube an insertable sealing sleeve 72 is inserted within sealing sleeve 52. The double taper inner walls of sleeve 52 contact the exterior surface 74 of sleeve 72 in the same manner as they contacted transfer tube 30 providing an airtight seal between the two sleeves. Sleeve 72 is designed with the same double-taper as sleeve 52 to contact and seal transfer tube 30.

Figure 10:
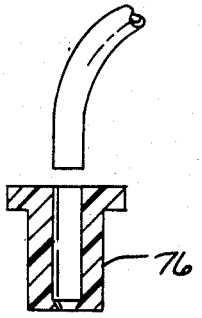
FIG. 10 is a cross-sectional side view of an interchangeable cylindrical sealing sleeve.

As shown in FIG. 10, a still smaller transfer tube 76 may be utilized by changing the configuration of insert sleeve 78. The external diameter of the sleeve 78 remains the same, with the inner diameter decreased. However, sleeve 78 still retains the double-taper configuration.

Alternatively, the second insert sleeve 78 may be designed so as to be inserted within insert sleeve 72 of FIG. 9. This allows for the change of sizes of transfer tubes by either a single insert sleeve, such as sleeve 72, or by a combination of two or more sleeves of succeedingly smaller diameters, such as sleeves 78 and 72.

Figure 11:
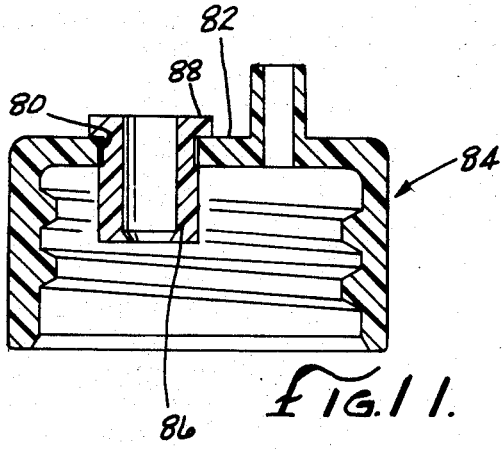
FIG. 11 is an alternate embodiment of the configuration shown in FIG. 9.
Figure 12:
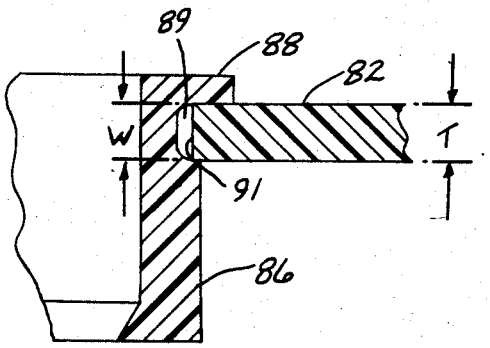
FIG. 12 is a partial cross-sectional side view of FIG. 11.

A different embodiment of the sealing sleeve is shown in FIGS. 11 and 12. In this embodiment the sealing sleeve is not an integral part of the lid. An aperture 80 is provided in the top 82 of lid 84. A sealing sleeve 86 is inserted within the aperture 80. To provide an airtight seal about the aperture 80 the external diameter of sleeve 86 is greater than the diameter aperture 80. A ring 88 is formed at the upper end of the sleeve 86 and is of a greater diameter than the external diameter of the sleeve 86. A channel 89 circumscribes the sleeve adjacent to the bottom 90 of ring 88.

Sleeve 86 is inserted within aperture 80 until ring bottom 90 engages lid top 82. The lid will then be seated within channel 89 a shown in FIG. 12. As shown in FIG. 12 both the wall of sleeve 86 and ring 88 extend past the inner face 91 of aperture 80 providing a seal about the aperture. To insure an adequate seal, the width "w" of channel 89 is slightly less than the thickness "T" of the lid. The sleeve 86 is of the same double taper configuration previously described.

The bushing type inserts shown in FIGS. 11 and 12 may be used singularly or in combination as with insertable sleeves 78 and 72. Further, once having utilized a bushing type sleeve insert, such as sleeve 86, insertable sleeves such as 72 or 78 may then be used to further reduce the size of transfer tube being used.

Having thus described the preferred embodiments of the invention, is to be understood that alternate embodiments which do not depart from the teachings herein will be readily apparent to those skilled in the art. The invention is not to be imited to the embodiments disclosed herein, but is to be accorded the full breadth and range of the appended claims.

What is claimed:

1. A container lid for liquid transfer comprising:

a lid having an upper and a lower side;

a hollow fluid transfer sleeve extending outward from the lower side of the lid, forming a fluid transfer passage in the lid, wherein said hollow fluid transfer sleeve has a double-inwardly tapered interior wall comprised of a first taper extending from the lid to an intermediate point along the sleeve and a second taper extending from said intermediate point to the end of the sleeve, said second taper being of a greater angle than said first taper; and a hollow air transfer sleeve extending outward from the upper side of the lid wherein said air transfer sleeve forms an air transfer aperture in the lid.

2. A container lid apparatus for liquid transfe comprising:

a lid having an upper and a lower side;

a hollow fluid transfer sleeve extending outward from the lower side of the lid, forming a fluid transfer passage in the lid, wherein said hollow fluid transfer sleeve has a double-inwardly tapered interior wall comprised of a first taper extending from the lid to an intermediate point along the sleeve and a second taper extending from said intermediate point to the end of the sleeve, said second taper being of a greater angle than said first taper;

a hollow air transfer sleeve extending outward from the upper side of the lid wherein said air transfer sleeve forms an air transfer aperture in the lid; and fastening means for fastening said lid to a container.

3. A container lid apparatus for liquid transfer comprising:

a lid having an upper and a lower side;

a hollow fluid transfer sleeve extending outward from the lower side of the lid, forming a fluid transfer passage in the lid, wherein said hollow fluid transfer sleeve has a double-inwardly tapered interior wall comprised of first taper extending from the lid to an intermediate point along the sleeve and a second taper extending from said intermediate point to the end of the sleeve, said second taper being of a greater angle than said first taper;

a hollow air transfer sleeve extending outward from the upper side of the lid wherein said air transfer sleeve forms an air transfer aperture in the lid;

a container;

fastening means for fastening said lid to said container;

vacuum means for withdrawing air from the container through the air transfer sleeve; and a fluid transfer conduit, said conduit passing through said hollow fluid transfer sleeve into said container.

4. A container lid for liquid transfer comprising:

a lid having an upper and a lower side;

a hollow fluid transfer sleeve extending outward from the lower side of the lid forming a fluid transfer passage through the lid wherein said hollow fluid transfer sleeve has a double-inwardly tapered interior wall comprised of a first taper extending from the lid to an intermediate point along the sleeve and a second taper extending from said intermediate point to the end of the sleeve, said second taper being of a greater angle than said first taper; and valve means connected to said lid for allowing air flow through the lid.

5. The container lid for liquid transfer of claim 4 wherein the valve means is comprised of a first and second aperture in the lid and a flexible sealing member having a tab extending perpendicularly from one end wherein said tab is press fit within said first aperture such that said flexible sealing member is aligned over said second aperture.

6. A container lid for liquid transfer comprising:

a lid having an upper and a lower side;

a hollow fluid transfer sleeve extending outward from the lower side of the lid forming a fluid transfer passage through the lid wherein said hollow fluid transfer sleeve has a double-inwardly tapered interior wall comprised of a first taper extending from the lid to an intermediate point along the sleeve and a second taper extending from said intermediate point to the end of the sleeve, said second taper being of a greater angle than said first taper; and valve means comprising of a first and second aperture in the lid and a flexible sealing member having a tab extending perpendicularly from one end wherein said tab is pres fit within in said first aperture such that said flexible sealing member is aligned over said second aperture.

7. A container lid for liquid transfer comprising:

a lid having an upper and a lower side;

a hollow fluid transfer sleeve extending outward from the lower side of the lid, forming a fluid transfer passage in the lid, wherein said hollow fluid transfer sleeve has a double-inwardly tapered interior wall comprised of a first taper of approximately 1° extending from the lid to an intermediate point approximately 1/16 inch from the end of the sleeve and a second taper of approximately 10° extending from said intermediate point to the end of the sleeve, said sleeve being approximately $\frac{5}{8}$ inches in length; and a hollow air transfer sleeve extending outward from the upper side of the lid wherein said air transfer sleeve forms an air transfer aperture in the lid.

8. A container lid for liquid transfer comprising:

a lid having an upper and a lower side, said lid also having an aperture therein;

a hollow fluid transfer sleeve inserted through the lid aperture and extending outward from the lower side of the lid, forming a fluid transfer passage in the lid, wherein said hollow fluid transfer sleeve has double-inwardly tapered interior wall comprised of a first taper extending from the lid to an intermediate point along the sleeve and a second taper extending from said intermediate point to the end of the sleeve, said second taper being of a greater angle than said first taper; and a hollow air transfer sleeve extending outward from the upper side of the lid wherein said air transfer sleeve forms an air transfer aperture in the lid.

9. A container lid apparatus for liquid transfer comprising:

a lid having an upper and a lower side, said lid also having an aperture therein;

a hollow fluid transfer sleeve inserted through the lid aperture and extending outward from the lower side of the lid, forming a fluid transfer passage in the lid, wherein said hollow fluid transfer sleeve has a double-inwardly tapered interior wall comprised of a first taper extending from the lid to an intermediate point along the sleeve and second taper extending from said intermediate point to the end of the sleeve, said second taper being of a greater angle than said first taper;

a hollow air transfer sleeve extending outward from the upper side of the lid wherein said air transfer sleeve forms an air transfer aperture in the lid; and fastening means for fastening said lid to a container.

10. A container lid apparatus for liquid transfer comprising:

a lid having an upper and a lower side, said lid also having an aperture therein;

a hollow fluid transfer sleeve inserted through said lid aperture and extending outward from the lower side of the lid, forming a fluid transfer passage in the lid, wherein said hollow fluid transfer sleeve has a double-inwardly tapered interior wall comprised of a first taper extending from the lid to an intermediate point along the sleeve and a second taper extending from said intermediate point to the end of the sleeve, said second taper being of a greater angle than said first taper;

a hollow air transfer sleeve extending outward from the upper side of the lid wherein said air transfer sleeve forms an air transfer aperture in the lid;

a container;

fastening means for fastening said lid to said container;

vacuum means for withdrawing air from the container through the air transfer sleeve; and a fluid transfer conduit, said conduit passing through said hollow fluid transfer sleeve into said container.

11. A container lid for liquid transfer comprising:

a lid having an upper and a lower side, said lid also having an aperture therein;

a hollow fluid transfer sleeve inserted through said lid aperture and extending outward from the lower side of the lid forming a fluid transfer passage through the lid wherein said hollow fluid transfer sleeve has a double-inwardly tapered interior wall comprised of first taper extending from the lid to an intermediate point along the sleeve and a second taper extending from said intermediate point to the end of the sleeve, said second taper being of a greater angle than said first taper; and valve means connected to said lid for allowing air flow through the lid.

12. The container lid for liquid transfer of claim 11 wherein the valve means is comprised of a first and second aperture in the lid and a flexible sealing member having a tab extending perpendicularly from one end wherein said tab is press fit within said first aperture such that said flexible sealing member is aligned over said second aperture.

13. A container lid for liquid transfer comprising:

a lid having an upper and a lower side, said lid also having an aperture therein;

a hollow fluid transfer sleeve inserted through said lid aperture and extending outward from the lower side of the lid forming a fluid transfer passage through the lid wherein said hollow fluid transfer sleeve has a double-inwardly tapered interior wall comprised of a first taper extending from the lid to an intermediate point along the sleeve and a second taper extending from said intermediate point to the end of the sleeve, said second taper being of a greater angle than said first taper; and valve means comprising of a first and second aperture in the lid and a flexible sealing member having a tab extending perpendicularly from one end wherein said tab is press fit within in said first aperture such that said flexible sealing member is aligned over said second aperture.

14. A container lid for liquid transfer comprising:

a lid having an upper and a lower side; and a hollow fluid transfer sleeve extending outward from the lower side of the lid forming a fluid transfer passage through the lid wherein said hollow fluid transfer sleeve has a double-inwardly tapered interior wall comprised of a first taper extending from the lid to an intermediate point along the sleeve and a second taper extending from said intermediate point to the end of the sleeve, said second taper being of a greater angle than said first taper.

15. A container lid for liquid transfer comprising:

a lid having an upper and a lower side, said lid also having an aperture therein; and hollow fluid transfer sleeve inserted through said lid aperture and extending outward from the lower side of the lid forming a fluid transfer passage through the lid wherein said hollow fluid transfer sleeve has a double-inwardly tapered interior wall comprised of first taper extending from the lid to an intermediate point along the sleeve and a second taper extending from said intermediate point to the end of the sleeve, said second taper being of a greater angle than said first taper.

* * * * *